US012320289B1

(12) United States Patent
Hedrick et al.

(10) Patent No.: US 12,320,289 B1
(45) Date of Patent: Jun. 3, 2025

(54) PASSIVE SURGE TANK PRESSURE AUGMENTATION

(71) Applicant: GM GLOBAL TECHNOLOGY OPERATIONS LLC, Detroit, MI (US)

(72) Inventors: Jacob C Hedrick, Shelby Township, MI (US); Scott D. Gendron, Ypsilanti, MI (US); David Alexander Schmitt, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 10 days.

(21) Appl. No.: 18/519,739

(22) Filed: Nov. 27, 2023

(51) Int. Cl.
*F01P 11/02* (2006.01)
*F01P 11/14* (2006.01)

(52) U.S. Cl.
CPC ..... *F01P 11/029* (2013.01); *F01P 11/0285* (2013.01); *F01P 11/14* (2013.01); *F01P 2025/04* (2013.01); *F01P 2060/12* (2013.01)

(58) Field of Classification Search
CPC ..... F01P 11/029; F01P 11/0285; F01P 11/14; F01P 11/18; F01P 2025/04; F01P 2060/12; F02M 35/10157
See application file for complete search history.

(56) References Cited

U.S. PATENT DOCUMENTS

| | | | | |
|---|---|---|---|---|
| 10,669,924 | B2 * | 6/2020 | Di Martino | F01P 3/20 |
| 11,519,320 | B2 * | 12/2022 | Rapp | B60K 11/02 |
| 2002/0112678 | A1 * | 8/2002 | Langervik | F01P 3/2207 123/41.3 |
| 2011/0308484 | A1 * | 12/2011 | Peterson | F01P 11/029 123/41.01 |
| 2022/0042446 | A1 * | 2/2022 | Rapp | F01P 11/0238 |

* cited by examiner

*Primary Examiner* — Grant Moubry
(74) *Attorney, Agent, or Firm* — Lorenz & Kopf LLP

(57) ABSTRACT

Methods and apparatus are provided for pressurizing a liquid cooling system including a pressurized air source configured to supply compressed air and a surge tank for storing a liquid coolant and for pressurizing an interior volume of the surge tank such that a coolant pressure is maintained at the desired operating pressure.

20 Claims, 3 Drawing Sheets

PASSIVE SURGE TANK PRESSURE AUGMENTATION

INTRODUCTION

The present disclosure relates generally to a system for passive pressure control in a vehicle coolant surge tank in a pressurized reservoir coolant diverter for automobile applications. More specifically, aspects of the present disclosure relate to systems, methods and devices for pressurizing a vehicle coolant system using pneumatic pressure generated by a vehicle compressor.

Traditionally vehicle cooling systems had a coolant overflow bottle physically attached, through use of a hose, to the radiator pressure cap area where an extra coolant volume was located for management of coolant expansion and contraction and purging of any air located in the cooling system. The pressure cap area is usually located at the highest point of the system and thus was a good location for many years. As vehicle cooling systems become larger and more complex, controlling a coolant pressure to ensure the required flow rate becomes more difficult. Furthermore, it can be difficult to achieve a complete fill, resulting in more cold fill compressibility than expected from a simple tank-based gas compression process during fluid expansion.

Maintaining coolant pressure in a vehicle cooling system is important for improving engine performance, efficiency, and durability. Maintaining a desired coolant pressure reduces the probability of boiling the coolant. As is generally known, coolant under pressure boils at a higher temperature than coolant at atmospheric pressure. Increased coolant pressure additionally reduces the risk of cavitation and improves heat transfer. Cavitation is a phenomenon that occurs when the pressure of a liquid drops below its vapor pressure. This can cause reduced coolant flow, resulting in inefficient system cooling.

Accordingly, it is desirable to address the aforementioned problems and to provide systems and methods for maintaining a vehicle coolant pressure. Furthermore, other desirable features and characteristics of the present disclosure will become apparent from the subsequent detailed description and the appended claims, taken in conjunction with the accompanying drawings and the foregoing technical field and background.

The above information disclosed in this background section is only for enhancement of understanding of the background of the invention and therefore it may contain information that does not form the prior art that is already known in this country to a person of ordinary skill in the art.

SUMMARY

Disclosed herein are vehicle system cooling methods and systems and related control logic for provisioning vehicle cooling systems, methods for making and methods for operating such cooling systems, and motor vehicles equipped with onboard cooling systems. By way of example, and not limitation, there are presented various embodiments of systems for passively augmenting a vehicle coolant pressure using pneumatic pressure in a motor vehicle disclosed herein.

In accordance with an aspect of the present disclosure, a pressurized liquid coolant system including a pressurized air source configured to supply compressed air, and a surge tank for storing a liquid coolant and for pressurizing an interior volume of the surge tank such that a coolant pressure is maintained at the desired operating pressure.

In accordance with another aspect of the present disclosure, an airway for coupling the compressed air between the pneumatic compressor and the reducing valve, a check valve for limiting the flow, either gas or liquid, back into the pressurized air source when the source pressure is reduced below a limit, and a reducing valve for stopping a flow of the compressed air in response to a pressure of the compressed air exceeding a desired operating pressure.

In accordance with another aspect of the present disclosure, an impedance detector for detecting an impedance of a content of the airway, and the check valve further configured for restricting an airflow of the airway in response to the impedance being less than a threshold impedance value.

In accordance with another aspect of the present disclosure, a pressure sensor for determining the pressure of the compressed air and for controlling a source of the compressed air in response to the impedance being less than a threshold impedance value.

In accordance with another aspect of the present disclosure, a restrictor valve for restricting a flow rate of the compressed air between the pressurized air source and the reducing valve.

In accordance with another aspect of the present disclosure, wherein the pressurized air source is a turbocharger.

In accordance with another aspect of the present disclosure, wherein the pressurized air source is a centrifugal compressor driven by an electric motor.

In accordance with another aspect of the present disclosure, a pressure relief valve disposed between the interior volume of the surge tank and an exterior volume such that air from the interior volume of the surge tank having an air pressure exceeding a maximum operative pressure is released to the exterior volume.

In accordance with another aspect of the present disclosure, an internal combustion engine cooling system and wherein the pressurized liquid coolant system is configured to maintain the desired operating pressure in the internal combustion engine cooling system.

In accordance with another aspect of the present disclosure, a method for pressurizing a liquid cooling system including generating, with a compressor, a compressed air, regulating, by a reducing valve, an air pressure of the compressed air to generate a regulated compressed air, and pressurizing a surge tank for storing a liquid coolant using the regulated compressed air, wherein surge tank forms a portion of the liquid cooling system.

In accordance with another aspect of the present disclosure, detecting an electrical impedance within an airway for coupling the compressed air between the compressor and the reducing valve, and preventing a flow of a liquid between the reducing valve and the compressor in response to the electrical impedance being less than a threshold impedance.

In accordance with another aspect of the present disclosure, including controlling the compressor to reduce the air pressure of the compressed air in response to the electrical impedance being less than the threshold impedance.

In accordance with another aspect of the present disclosure, including detecting, with a pressure sensor, a pressure of the compressed air and coupling the compressed air from the compressor to the reducing valve in response to the pressure exceeding a minimum threshold value.

In accordance with another aspect of the present disclosure, wherein the regulated compressed air is regulated to a desired cooling system operating pressure.

In accordance with another aspect of the present disclosure, wherein the regulated compressed air is regulated to 225 kPa.

In accordance with another aspect of the present disclosure, including releasing, by an overpressure valve, the regulated compressed air from the surge tank in response to a pressure of the regulated compressed air exceeding a maximum operating pressure threshold.

In accordance with another aspect of the present disclosure, including detecting, using a pressure sensor, the air pressure of the compressed air and regulating, by a restrictor valve, a coupling of the compressed air into an airway including the reducing valve in response to the air pressure.

In accordance with another aspect of the present disclosure, wherein a check valve prevents the coupling of the compressed air into the airway in response to the air pressure being less than a minimum threshold pressure.

In accordance with another aspect of the present disclosure, a vehicle cooling system including a compressor for generating a compressed air, a pressure sensor for detecting a pressure of the compressed air, a check valve for coupling the compressed air to an airway in response to the pressure of the compressed air exceeding a threshold pressure, a restrictor valve for restricting a flow rate of the compressed air in the airway, a reducing valve for reducing the pressure of the compressed air from the restrictor valve to a desired operating pressure, and a surge tank for supplying a pressurized coolant to a vehicle engine in response to the compressed air having the desired operating pressure from the reducing valve.

In accordance with another aspect of the present disclosure, including an impedance sensor for generating a signal indicative of an impedance of the compressed air and a liquid within the airway and a controller for controlling a preventative action in response to the impedance being indicative of the liquid within the airway.

BRIEF DESCRIPTION OF THE DRAWINGS

The exemplary embodiments will hereinafter be described in conjunction with the following drawing figures, wherein like numerals denote like elements, and wherein.

The exemplifications set out herein illustrate preferred embodiments of the invention, and such exemplifications are not to be construed as limiting the scope of the invention in any manner.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
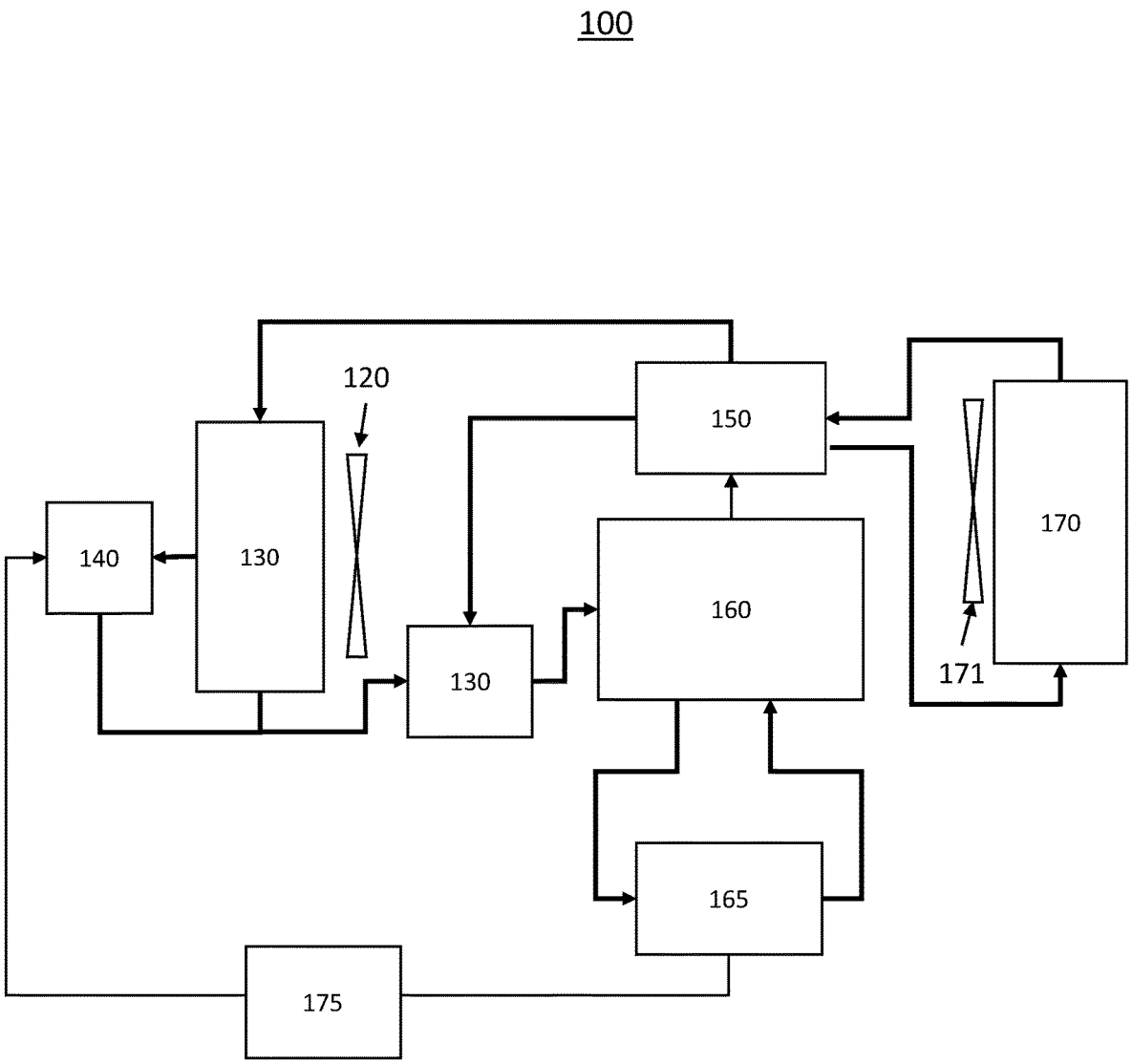
FIG. 1 shows an application for the method and apparatus for passive surge tank pressure augmentation using pneumatic pressure in a motor vehicle according to an exemplary embodiment of the present disclosure.

Turning now to FIG. 1, an exemplary system 100 for passive surge tank pressure augmentation using pneumatic pressure in a motor vehicle is shown. The exemplary system 100 includes a motor 160, a radiator 130, a radiator fan 120, a coolant pump 130, a thermostat 150, a heater core 170, a heater fan 171, a surge tank 140, a turbocharger 165 and an air regulator 175.

The exemplary system 100 can be a cooling system for a vehicle propulsion system. The various elements of the system 100 are configured to route liquid coolant in order to remove heat from the motor 160 and the turbocharger 165. The radiator 130 and the heater core 170 are heat exchangers configured to receive heated coolant, to route the heated coolant through a plurality of thin thermally conductive tubes and fins. The tubes and fins absorb heat from the coolant as it passes through the tubes. The heat is then transferred to the air by the thermally conductive fins. The radiator fan 120 and the heater fan 171 are configured to increase airflow through the fins and tubes in increase the amount of heat transferred from the coolant to the air.

The motor 160 can be an internal combustion engine or an electric motor used as part of a vehicle drive train to propel a vehicle. The motor 160 generates heat during operation and the coolant is pumped, by the coolant pump 130, through channels within the motor housing to transfer heat to the coolant and away from the motor 160. Likewise, the turbocharger 165 can generate heat and/or can be damaged by heat from exhaust gases from a combustion process in an internal combustion engine. The turbocharger 165 can further be configured with coolant channels for transferring this heat from the turbocharger 165 to the radiator 130 via the coolant. One particular challenge of cooling turbochargers is that if the coolant flow or pressure is not at a sufficient level, after boil can occur.

After boil in a turbocharger is a phenomenon where coolant temperature rises above the boiling point in the cooling cavity of the turbocharger. This can occur when the engine is shut off and the coolant pump 130 ceases to pump, or reduces the flow of, coolant through the cooling system. After boil can be caused by the heat stored in the turbine housing and exhaust manifold transferring to the center section of the turbocharger, which causes the oil to break down and lose its viscosity. After boil can lead to bearing damage and premature turbocharger failure. This is especially true for liquid cooled turbochargers, as the heat from the turbine housing and exhaust manifold can cause the water to boil and create steam.

The thermostat 150 regulates the flow of coolant between the motor 160 and the radiator 130, helping to keep the motor 160 running at its optimal temperature. When the motor 160 is cold, the thermostat 150 prevents, or at least inhibits, the coolant from circulating through the radiator 130, which allows the motor 160 to warm up quickly. As the motor 160 heats up, the thermostat 150 allows more and more coolant to circulate through the radiator 130, which helps to cool the motor 160. In some exemplary embodiments, the thermostat 150 may be implemented using a valve that is configured to open and close at a specific temperature, such as approximately 200 degrees Fahrenheit, to ensure that the motor 160 runs at the correct temperature, regardless of the outside temperature or driving conditions.

The surge tank 140, also known as a coolant expansion tank or overflow tank, is a reservoir that holds excess coolant for the system 100. The surge tank 140 provides a volume for excess coolant to expand and assists in maintain the correct coolant volume. For example, as the motor 160 heats up, the coolant expands and the surge tank 140 provides a volume for this expanded coolant. Conversely, when the motor 160 cools down, the coolant contracts, and coolant in the surge tank 140 can then flow back into the system to maintain the correct coolant volume. The surge tank 140 is further configured to prevent air from entering the cooling system. Air bubbles in the cooling system can reduce its efficiency and lead to overheating by reducing the local heat transfer performance. The surge tank 140 helps to prevent air from entering the system by separating any gases from liquid coolant by providing a place for coolant to expand and contract. The surge tank 140 can then supply the coolant system the required volume of coolant during coolant contraction as opposed to the cooling system drawing in air during contraction. Upon the expansion process, the tank pressurizes by compressing the trapped air volume to maintain an improved thermodynamic state, which maintains cooling system performance as the coolant heats up. Maintaining the correct coolant volume is important to keep the motor from running too hot if the coolant level is too low, or preventing overflow of the coolant if the coolant level is too high in the expansion process.

In more complex and extensive cooling systems, maintaining coolant volume and pressure can be challenging. With the goal of achieving a coolant system pressure faster than conventional means, such as closed system heat addition or allowing overflow tank coolant overflow at a lower-than-otherwise-required cap pressure, higher pressure air, such as from pressurized air generated by the turbocharger 165, can be used to supply air to pressurize the surge tank 140 up to the design specification. The filling rate of the surge tank 140 can be limited with the air regulator 175, or restrictor, to not bias air metering accuracy significantly at any instant.

Figure 2:
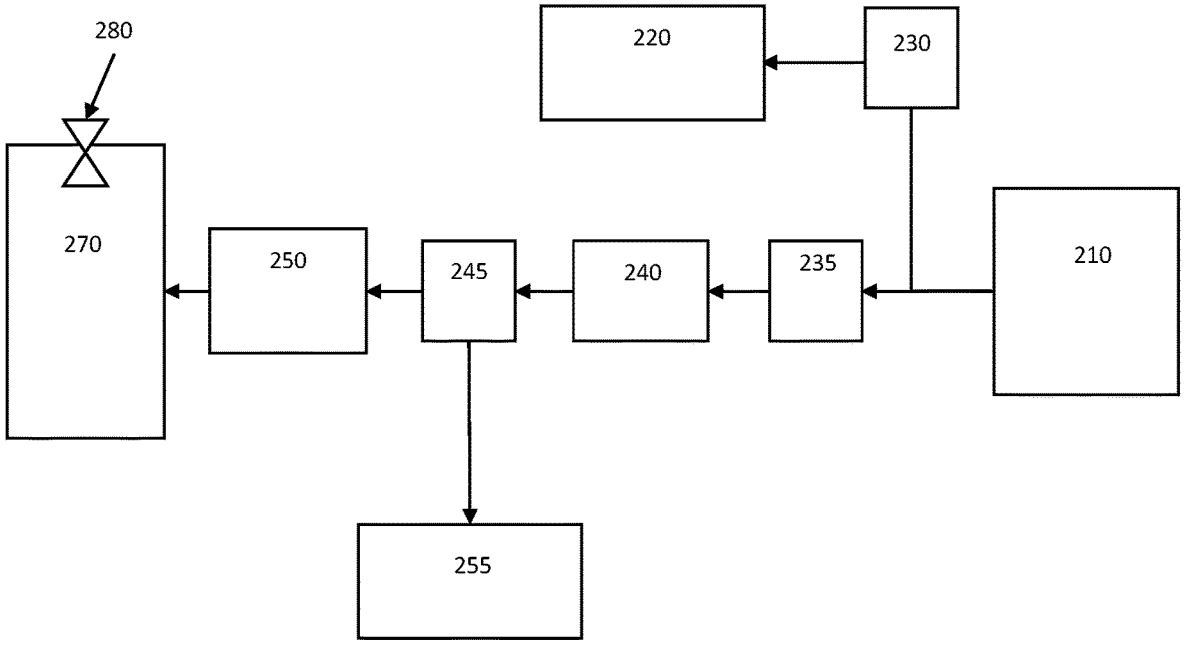
FIG. 2 shows a block diagram of an exemplary system for passive surge tank pressure augmentation using pneumatic pressure in a motor vehicle according to an exemplary embodiment of the present disclosure.

Turning now to FIG. 2, an exemplary passive surge tank pressure augmentation system 200 is shown. The exemplary passive surge tank pressure augmentation system 200 can include a pressurized air source 210, a primary airflow outlet 220, a manifold absolute pressure (MAP) sensor 230, a check valve 235, a restrictor valve 240, a reducing valve 250, surge tank 270 and an overpressure valve 280.

In some exemplary embodiments, the pressurized air source 210 can be a compressor, such as a centrifugal compressor, and/or a device that increases the pressure of a gas by reducing its volume. For example, a turbocharger, such as the turbocharger 165 depicted in FIG. 1, includes a compressor which uses exhaust gas from an internal combustion engine to rotate a turbine, which in turn rotates an impeller via a shaft. Ambient air is supplied to the impeller via an intake. The impeller accelerates the intake air and directs the accelerated air towards a diffuser. The diffuser converts the kinetic energy of the accelerated air into pressure energy resulting in compressed air to the primary airflow 220. In some exemplary embodiments, this primary airflow 220 can be the intake of an internal combustion engine. This compressed air has an increased oxygen content and can increase the power of the internal combustion engine by allowing the engine to burn more fuel and burn that fuel more efficiently. While pressurized air source 210 is described as a turbocharger in some exemplary embodiments, any pressurized air source, compressor or pneumatic source can be used as a source of pressurized gas for the exemplary system 200. For example, primary airflow 220 path could be supplied by any higher-than-threshold compressed air volume, not just post compressor or intake manifold, such as a high pressure cooled exhaust gas.

In some exemplary embodiments, some of the pressurized gas generated by the pressurized air source 210 can be used to provide a secondary airflow, passively pressurizing the coolant system. A MAP sensor 230 is a device that measures the absolute pressure of the air in the intake manifold of an internal combustion engine. The MAP sensor 230 readings can be used by the engine control unit (ECU) to calculate the air mass flow rate, which can be used for determining fuel injection and ignition timing. The MAP sensor 230 can be located on the intake manifold, and for a turbocharged or supercharged engine, the MAP sensor 230 may be located on the intake tract after the turbo or supercharger. The MAP sensor 230 can be used to send signals to the engine control unit (ECU), which then adjusts the boost pressure of the turbocharger. This allows the ECU to maintain the optimal air-fuel ratio for the engine, which maximizes power and fuel efficiency. In some exemplary embodiments, a throttle inlet air pressure (TIAP) can be used in conjunction with the MAP to measure the pressure between the compressor and the throttle which can be the source of the second airway pressurized air.

The exemplary passive surge tank pressure augmentation system 200 can include a check valve 235 located within the secondary airflow path. The check valve can be a passive valve that allows air to flow in one direction, but prevents air from flowing in the other direction. In some exemplary embodiments, the check valve 235 can begin to open the secondary airflow path at 130 kPa MAP and can fully open the secondary airflow path in response to a pressure differential between the upstream air pressure and the downstream air pressure of less than 20 kPa.

The secondary airflow can then be coupled from the check valve 235 to an airflow restrictor 240. An airflow restrictor 240 is a device that is used to control the flow of air through a system. The airflow restrictor valve 240 can work by creating a restriction in the flow path of the air. This restriction reduces the maximum mass flow through the airflow restrictor valve 240, which reduces the second air path flow rate. The amount of restriction can be adjusted to achieve the desired flow rate. In some exemplary embodiments, the desired flow rate is delivering a mass flow that is not greater than the maximum allowed for ECU diagnostics to detect primary air flow path leaks. In some exemplary embodiments, the ECU can disable and/or ignore airflow diagnostics between the compressor 210 and the primary airflow 220 if active air flow between within the secondary airflow path is detected until the air flow in the secondary airflow path has ceased.

The restricted compressed air can next be coupled to a reducing valve 250 which can limit the airflow pressure applied to the surge tank. The reducing valve 250 can be used to maintain the desired pressure in the cooling system. The reducing valve 250 can employ a diaphragm or piston to control the flow of gas through the valve. The diaphragm or piston is actuated by a spring or by a pilot valve. The spring or pilot valve is set to the desired pressure, and when the upstream pressure exceeds the desired pressure, the diaphragm or piston will move to close the valve and restrict the flow of gas, thereby reducing the pressure of the gas downstream of the valve. In some exemplary embodiments, this desired pressure can be 225 kPa and the reducing valve 250 can be configured to close at 225 kPa, thereby limiting the pressure introduced to the cooling system to 225 kPa.

In some exemplary embodiments, the surge tank 270 can be a pressurized coolant surge tank that acts as a reservoir to store coolant. The exemplary passive surge tank pressure augmentation system 200 is configured to maintain a desired coolant pressure in the surge tank 270 and the coolant system by receiving compressed air from the secondary airflow. Maintaining a constant pressure in the cooling system is important in order to prevent the coolant from boiling and prevents the formation of air pockets in the system. The surge tank 270 further acts as a reservoir for coolant expansion. As the coolant heats up, it expands. The surge tank 270 provides a place for the coolant to expand without causing the pressure in the system to rise too high. The surge tank 270 can help to prevent coolant overflow. If the pressure in the cooling system rises too high, the coolant may overflow from the radiator. The surge tank 270 provides a reservoir for the excess coolant resulting from the thermal expansion.

In addition to preventing coolant overflow, the pressurized coolant surge tank 270 acts to prevent the coolant from boiling and can prevent air pockets from forming in the cooling system. The pressurized coolant surge tank 270 raises the boiling point of the coolant, which prevents it from boiling over. This is especially important in hot climates, when driving under heavy load and when using turbochargers which can be susceptible to after boil. Air pockets in the cooling system can reduce the efficiency of the cooling system and can lead to overheating. A pressurized coolant surge tank helps to prevent air pockets from forming by maintaining a constant pressure in the system.

The overpressure valve 280 can be used with the pressurized coolant surge tank 270 to prevent over pressurization of the coolant system 200. The overpressure valve 280 is configured to release excess pressure from the system. Overpressure valves in vehicle cooling systems are typically located on the radiator cap or on the surge tank 270. The overpressure valve 280 is designed to open at a predetermined pressure level higher than the normal operating pressure of the coolant system. When the pressure in the coolant system exceeds the predetermined level, the overpressure valve 280 opens and releases excess pressurized gas to prevent the coolant system from becoming over pressurized and rupturing. Advantageously, when the overpressure valve 280 is activated to reduce pressure within the cooling system, the pneumatic system can restore the coolant system pressure to the desired coolant pressure.

In some exemplary embodiments, the overpressure valve 280 can be a three-stage pressure relief valve. A three-stage pressure relief valve can have three stages of operation providing gas release outlets at differing flow rates for differing pressure levels. For example, the first stage of the three-stage pressure relief valve can release a first volume of gas when the pressure inside the cooling system exceeds a first threshold pressure. If the pressure continues to rise, the three-stage pressure relief valve can release a larger volume of gas at a second threshold pressure. Finally, the three-stage pressure relief valve fully open to release a maximum volume of gas at a third threshold pressure, wherein the third threshold pressure is greater than the second threshold pressure and the second threshold pressure is greater than the first threshold pressure. In some exemplary embodiments, one of the stages, such as the second stage, can be a manually actuated pressure release stage, allowing a user to manually or electronically transition the three stage pressure relief valve from the first stage to the second stage. In some exemplary embodiments, a user may actuate a lever to transition the three stage pressure relief valve between stages. Alternatively, the user may rotate the pressure relief valve from a first position to a second position having a stop detent for transitioning the three stage pressure relief valve between stages.

In some exemplary embodiments, an impedance sensor 245 can be employed in the secondary airflow as a diagnostic system used to detect fluid in the airflow path in order to prevent fluid from entering the primary air flow 220 path and/or the compressor 210. The impedance sensor can include a plurality of electrical conductivity sensors or the like. A signal or impedance value from the impedance sensor 245 can be coupled to a controller 255, such as a vehicle controller or the like, for detecting the presence of a liquid in the secondary airflow path. If an impedance indicative of a liquid in the secondary airflow path is detected, the controller 255 can be configured to execute preventative action, such as initiating a service call or limiting the boost as detected at the MAP sensor 230, resulting in a closing of the check valve 235, preventing fluid from entering the primary airflow path when the inlet to outlet pressure differential drops below a design limit. In some exemplary embodiments, a malfunction indicator lamp can be illuminated indicative of reduced engine performance and/or service of the passive surge tank 270 is required.

Figure 3:
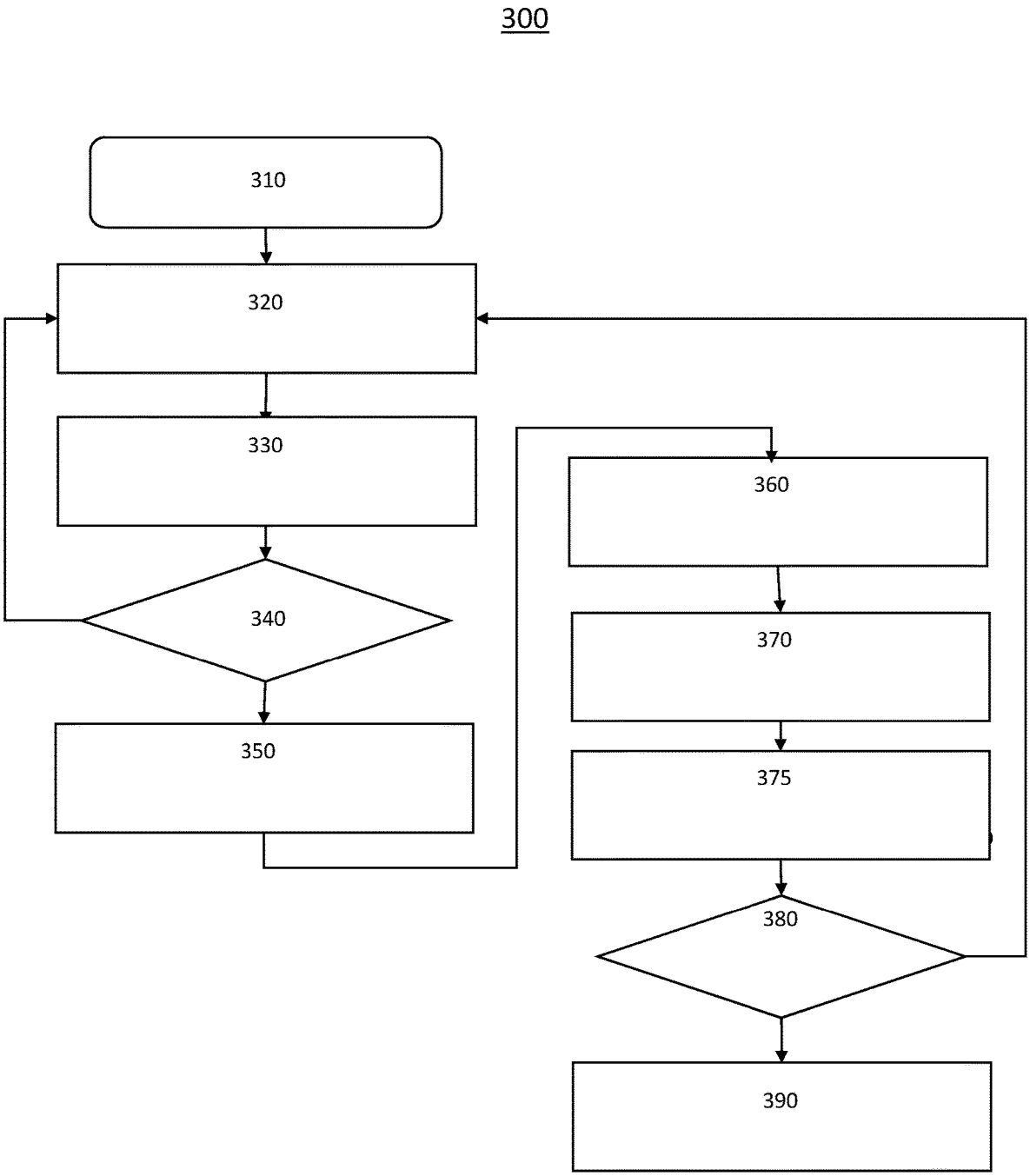
FIG. 3 shows a flow chart illustrating a method for passive surge tank pressure augmentation using pneumatic pressure in a motor vehicle according to an exemplary embodiment of the present disclosure.

Turning now to FIG. 3, a flow chart illustrating an exemplary method 300 for implementing passive surge tank pressure augmentation system in a motor vehicle is shown. The method is first responsive to a vehicle initiation 310. The vehicle initiation 310 can be determined in response to a vehicle being transitioned from a standby state to a run state. In some exemplary embodiments, the vehicle initiation can be detected in a vehicle having an internal combustion engine when the engine is started and is running. For an electric vehicle, the vehicle initiation can be determined in response to a transition from a park state to a drive state or the like.

The method is next operative to generate 320 a pneumatic pressure. The pneumatic pressure can be generated using a pressurized pneumatic tank, a compressor, such as a turbocharger, a supercharger, a centrifugal compressor, a vehicle exhaust or the like. In some exemplary embodiments, the pneumatic pressure can be generated by a compressor's impeller and diffuser to generate pressurized air output to a vehicle intake manifold or the like.

The method is next operative to supply 330 the pneumatic pressure to a primary airflow path and a secondary airflow path. In some exemplary embodiments, the primary airflow path can be an intake manifold, or compressed air induction path measured by the TIAP sensor, on an internal combustion engine. An intake manifold is a series of tubes that connect an external air intake and the output of the turbocharger to the engine cylinders. For an electric vehicle, the primary airflow path can be a pressurized air cooling system. The secondary airflow path is a vehicle coolant surge tank augmentation system.

If the pneumatic pressure in the secondary airflow path 340 does not exceed the threshold value, the method prevents the pressurized air from being supplied to the secondary airflow path and returns to generating pneumatic pressure 320. In some exemplary embodiments, this primary threshold value can be 130 kPa. In some exemplary embodiments, the pressurized air can be passively closed and prevented from entering the secondary airflow path by a check valve when a differential pressure between the check valve inlet and the check valve outlet drops below a predetermined threshold differential.

If the pneumatic pressure in the secondary airflow path exceeds the threshold value, the method is next operative to restrict 350 the airflow in the secondary airflow path. An airflow restrictor can be used to restrict the flowrate of the compressed air. The airflow restrictor helps in reducing the rate of change of the pneumatic pressure or mass flow from conditions where the secondary air path is not coupled to the primary air path.

In some exemplary embodiments, the primary airflow path can be coupled to the secondary airflow path at a pre-charge air cooler and pre-throttle. The pressure can determined using TIAP if the throttle is closed, or MAP if the architecture of the air flow path allows the manifold to be directly coupled to the secondary air flow path with minimal restriction as typically the case with boosted operation even with a throttle. In some exemplary embodiments, the existence of flow in that path could be inferred using a temperature measurement as compressed gasses generally have a discernably higher sensible thermal state.

The method is next operative to regulate 360 an airflow pressure in the secondary airflow path. In some exemplary embodiments, the airflow pressure can be regulated using an air pressure reducing valve (PRV). A PRV can be used to reduce the pressure of air in a system in applications where a constant and lower air pressure is required. The airflow pressure can be restricted to a maximum desired pressure value, such as 225 kPa at which point, the PRV can close, preventing in increase in pressure over the maximum desired pressure value resulting from the compressed air in the secondary airflow path. The method next couples 370 the regulated compressed air from the reducing valve to a coolant surge tank. This compressed air is then used to increase or maintain a pressure of the coolant system to the maximum desired pressure value.

In some exemplary embodiments, the method can next be configured to detect 375 an electrical impedance in the secondary airflow path. The electrical impedance can be detected within the secondary airflow path using electrical conductivity sensors. The method next determines if 380 the detected impedance is less than a threshold value. The threshold impedance value can be indicative of a liquid in the secondary airflow path. The conductivity of air is much less than the conductivity of a liquid. Thus, if a liquid is detected in the secondary airflow path, the impedance between two or more electrical conductivity sensors will drop in magnitude. If the detected electrical impedance is greater than the threshold value, indicating an absence of liquid, such as coolant, in the secondary airflow path, the method returns to generating pneumatic pressure 320. If the electrical impedance is less than the threshold value, indicating a liquid in the secondary airflow path, the method can next take preventative action 390 to prevent the ingestion of liquid into the primary airflow path and damage to the compressor and components within the primary airflow path.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A pressurized liquid coolant system comprising:

a pressurized air source configured to supply compressed air;

a surge tank for storing a liquid coolant and for pressurizing an interior volume of the surge tank such that a coolant pressure is maintained at an operating pressure;

an airway for coupling the compressed air between the pressurized air source and a reducing valve;

a check valve for limiting the flow, either gas or liquid, back into the pressurized air source when the source pressure is reduced below a limit;

the reducing valve for stopping a flow of the compressed air in response to a pressure of the compressed air exceeding the operating pressure;

an impedance detector for detecting an impedance of a content of the airway; and the check valve further configured for restricting an airflow of the airway in response to the impedance being less than a threshold impedance value.

2. The pressurized liquid coolant system of claim 1 wherein the check valve is a passive valve.

3. The pressurized liquid coolant system of claim 2 wherein the impedance detector is an impedance sensor including a plurality of electrical conductivity sensors.

4. The pressurized liquid coolant system of claim 3, further comprising a pressure sensor for determining the pressure of the compressed air and for controlling a source of the compressed air in response to the impedance being less than a threshold impedance value.

5. The pressurized liquid coolant system of claim 1, further comprising a restrictor valve for restricting a flow rate of the compressed air between the pressurized air source and a reducing valve.

6. The pressurized liquid coolant system of claim 1 wherein the pressurized air source is a turbocharger.

7. The pressurized liquid coolant system of claim 1 wherein the pressurized air source is a centrifugal compressor driven by an electric motor.

8. The pressurized liquid coolant system of claim 1 including a pressure relief valve disposed between the interior volume of the surge tank and an exterior volume such that air from the interior volume of the surge tank having an air pressure exceeding a maximum operative pressure is released to the exterior volume.

9. The pressurized liquid coolant system of claim 1 is an internal combustion engine cooling system and wherein the pressurized liquid coolant system is configured to maintain the operating pressure in the internal combustion engine cooling system.

10. A method for pressurizing a liquid cooling system comprising:

generating, with a compressor, a compressed air;

regulating, by a reducing valve, an air pressure of the compressed air to generate a regulated compressed air;

pressurizing a surge tank for storing a liquid coolant using the regulated compressed air, wherein surge tank forms a portion of the liquid cooling system;

detecting an electrical impedance within an airway for coupling the compressed air between the compressor and the reducing valve; and preventing a flow of a liquid between the reducing valve and the compressor in response to the electrical impedance being less than a threshold impedance.

11. The method for pressurizing the liquid cooling system of claim 10 wherein the electrical impedance is detected by an impedance sensor including a plurality of electrical conductivity sensors.

12. The method of pressurizing the liquid cooling system of claim 11 including controlling the compressor to reduce the air pressure of the compressed air in response to the electrical impedance being less than the threshold impedance.

13. The method for pressurizing the liquid cooling system of claim 10 including detecting, with a pressure sensor, a pressure of the compressed air and coupling the compressed air from the compressor to the reducing valve in response to the pressure exceeding a minimum threshold value.

14. The method for pressurizing the liquid cooling system of claim 10 wherein the regulated compressed air is regulated to a cooling system operating pressure.

15. The method for pressurizing the liquid cooling system of claim 10 wherein the regulated compressed air is regulated to 225 kPa.

16. The method for pressurizing the liquid cooling system of claim 10 including releasing, by an overpressure valve, the regulated compressed air from the surge tank in response to a pressure of the regulated compressed air exceeding a maximum operating pressure threshold.

17. The method for pressurizing the liquid cooling system of claim 10 including detecting, using a pressure sensor, the air pressure of the compressed air and regulating, by a restrictor valve, a coupling of the compressed air into an airway including the reducing valve in response to the air pressure.

18. The method for pressurizing the liquid cooling system of claim 16 wherein a check valve prevents the coupling of the compressed air into the airway in response to the air pressure being less than a minimum threshold pressure.

19. A vehicle cooling system comprising;

a compressor for generating a compressed air;

a pressure sensor for detecting a pressure of the compressed air;

a check valve for coupling the compressed air to an airway in response to the pressure of the compressed air exceeding a threshold pressure;

a restrictor valve for restricting a flow rate of the compressed air in the airway;

a reducing valve for reducing the pressure of the compressed air from the restrictor valve to an operating pressure; and a surge tank for supplying a pressurized coolant to a vehicle engine in response to the compressed air having the operating pressure from the reducing valve.

20. The vehicle cooling system of claim 19 including an impedance sensor for generating a signal indicative of an impedance of the compressed air and a liquid within the airway and a controller for controlling a preventative action in response to the impedance being indicative of the liquid within the airway.

* * * * *